US005987934A

United States Patent [19]

Scholl

[11] Patent Number: 5,987,934

[45] Date of Patent: Nov. 23, 1999

[54] TEXTILE WET PROCESSING MACHINE HAVING AN ADJUSTABLE INNER WALL

[75] Inventor: Marc D. Scholl, Charlotte, N.C.

[73] Assignee: Scholl America, Inc., Gibsonville, N.C.

[21] Appl. No.: 09/128,920

[22] Filed: Aug. 4, 1998

Related U.S. Application Data

[63] Continuation-in-part of application No. 08/792,645, Jan. 31, 1997, Pat. No. 5,873,270.

[51] Int. Cl.[6] ..... D06B 3/26

[52] U.S. Cl. ..... 68/178

[58] Field of Search ..... 68/177, 178; 26/21

[56] References Cited

U.S. PATENT DOCUMENTS

| | | | |
|---|---|---|---|
| 1,209,880 | 12/1916 | Palmer . | |
| 1,531,788 | 3/1925 | Jefferson . | |
| 2,503,817 | 4/1950 | Graham | 68/178 |
| 3,921,420 | 11/1975 | Aurich | 68/5 C |
| 3,949,575 | 4/1976 | Turner | 68/5 C |
| 4,001,945 | 1/1977 | Aurich | 34/155 |
| 4,007,517 | 2/1977 | Turner | 26/18.5 |
| 4,114,407 | 9/1978 | Turner | 68/178 |
| 4,318,286 | 3/1982 | Sturkey | 68/178 |
| 4,340,986 | 7/1982 | Sturkey | 8/152 |
| 4,419,871 | 12/1983 | Zonco | 68/22 R |
| 5,014,526 | 5/1991 | Hacker | 68/178 |
| 5,577,282 | 11/1996 | Turner | 8/152 |
| 5,873,270 | 2/1999 | Scholl | 68/178 |

FOREIGN PATENT DOCUMENTS

| | | | |
|---|---|---|---|
| 212591 | 8/1909 | Germany | 26/21 |
| 29 45 942 A1 | 5/1981 | Germany . | |
| 576088 | 4/1958 | Italy | 68/177 |
| 20545 | 9/1984 | United Kingdom | 26/21 |

*Primary Examiner*—Philip R. Coe
*Attorney, Agent, or Firm*—Christopher C. Dremann, PC; Christopher C. Dremann

[57] ABSTRACT

A textile wet processing machine includes a processing chamber having an adjustable inner wall. The inner wall is continuously adjustable to accommodate textile fabrics in cloth rope form having great variations in weight, texture, thickness, flexibility and load. The inner wall may be positioned at any position relative to the outer wall of the processing chamber between a predetermined innermost position and a predetermined outermost position. In a preferred embodiment, adjustment is accomplished by a worm gear assembly, a transverse drive shaft coupled to the worm gear assembly and a linkage assembly. The worm gear assembly includes a worm gear positioned within a gear box housing that is rotated manually by a hand wheel, or is rotated automatically by an electric drive motor or pneumatic positioner programmed by an electronic processor to set the volumetric size of the processing chamber in accordance with a preselected textile fabric. The transverse drive shaft includes a worm wheel at one end adjacent the worm gear. The linkage assembly includes a first rigid link fixed to the transverse drive shaft and a second rigid link rotatably secured to the free end of the first rigid link. The free end of the second rigid link is secured to the inner wall such that rotation of the transverse drive shaft rotates the inner wall of the processing chamber about a transverse axis between the predetermined innermost position and the predetermined outermost position.

17 Claims, 3 Drawing Sheets

TEXTILE WET PROCESSING MACHINE HAVING AN ADJUSTABLE INNER WALL

CROSS REFERENCE TO RELATED APPLICATIONS

This application is a continuation-in-part of U.S. patent application Ser. No. 08/792,645, filed Jan. 31, 1997, now U.S. Pat. No. 5,873,270, issued Feb. 25, 1999.

FIELD OF THE INVENTION

The present invention relates generally to an apparatus for wet processing textile fabrics in cloth rope form. More particularly, the invention is a textile wet processing machine including a processing chamber having an adjustable inner wall to accommodate textile fabrics in cloth rope form having great variations in weight, texture, thickness, flexibility and load.

BACKGROUND OF THE INVENTION

Textile wet processing machines are utilized extensively in the textile industry. The term "wet processing" refers to the process of treating the textile fabric with a treatment liquid, such as a liquid dye solution. In a particular application, the wet processing machine is used to perform what is known as "piece dyeing" of large textile fabrics. The fabric is formed in a continuous ring that has the appearance of a thick rope. Thus, the term "continuous cloth rope" or "cloth rope" is used to describe the textile fabric. The cloth rope is inserted into the wet processing machine and circulated through a processing chamber containing a liquid dye solution. As the cloth rope is circulated through the processing chamber, it is referred to as a "cloth plug." As will be described hereafter, the cloth plug is repeatedly circulated through the processing chamber so that the liquid dye solution is dispersed uniformly throughout the textile fabric.

Known textile wet processing machines typically consist of three primary components. The first component is a large, hollow vessel for containing the treatment liquid. The vessel includes means for circulating the treatment liquid, and means for heating and cooling the treatment liquid. The vessel contains, without leakage, all of the treatment liquid used to treat the textile fabric. The second component is at least one U-shaped processing chamber having open ends. The processing chamber is positioned within the interior of the vessel and is typically formed of a pair of side walls, an outer wall extending transversely between the side walls, and an inner wall extending transversely between the side walls opposite the outer wall. The side walls, outer wall, and inner walls of the processing chamber typically have perforations therethrough to allow the treatment liquid to flow into and out of the processing chamber inside the vessel. The third component is a mechanical means, preferably located near the top of the vessel, for drawing the cloth rope out of the processing chamber so that the cloth rope is repeatedly circulated through the treatment liquid in the processing chamber.

The primary problem with the known textile wet processing machines is that they do not adequately accommodate different textile fabrics having great variations in weight, texture, thickness, flexibility and load. These variations are naturally exaggerated when the textile fabric is circulated in cloth rope form through a treatment liquid, such as a liquid dye solution. As is understood by those skilled in the art, the handling characteristics of the textile fabric are dramatically influenced by these variations. Accordingly, textile fabrics having great variations in the above mentioned properties behave quite differently in the wet processing machine and typically require a processing chamber of differing volumetric size to enable the machine to realize its maximum capacity for treating a preselected textile fabric.

Those skilled in the art of dyeing textile fabrics in cloth rope form realize that textile wet processing machines having processing chambers of fixed volumetric size cannot accommodate textile fabrics having great variations in weight, texture, thickness, flexibility and load. Dyeing machines manufactured to accommodate heavier or larger diameter cloth rope cannot also accommodate lighter or smaller diameter cloth rope. If a lighter or smaller diameter cloth rope is circulated through a processing chamber designed to accommodate a heavier or larger diameter cloth rope, the cloth rope is likely to tangle inside the processing chamber. Likewise, dyeing machines manufactured to accommodate a longer load of cloth rope, cannot also accommodate a shorter load of cloth rope. Similarly, if a shorter load of cloth rope is circulated through a processing chamber designed to accommodate a longer load of cloth rope, the cloth rope is likely to tangle inside the processing chamber of the dyeing machine.

In the past, manufactures of textile wet processing machines have responded to the above described problem by manufacturing machines of many different sizes to accommodate the wide range of handling characteristics created by the variations encountered in fabric weight, texture, thickness, flexibility and load. These machines have included proportionally sized processing chambers having fixed side, outer and inner walls. More recently, a textile wet processing machine has been developed which includes a processing chamber having an adjustable inner wall.

U.S. Pat. No. 5,014,526 issued May 14, 1991, to Hacker et al. discloses a textile wet processing machine including a U-shaped processing chamber provided with an adjustable inner wall. The inner wall includes C-shaped lateral flanges that permit the inner wall to be removably mounted between the side walls of the processing chamber. The inner wall is mounted to the side walls by a plurality of fasteners that are received in perforations pre-formed in the side walls. Because the inner wall may be repositioned by receiving the plurality of fasteners in different perforations in the side walls, the inner wall is selectively adjustable toward and away from the outer wall. Thus, the volumetric size of the interior of the processing chamber may be altered to accommodate the particular textile fabric being processed.

Disadvantageously, however, the adjustability of the inner wall of the wet processing machine disclosed in the patent to Hacker et al. is limited to the distance in the direction of movement of the inner wall toward or away from the outer wall between the centers of adjacent perforations in the side walls. Thus, the position of the inner wall relative to the outer wall is selectively adjustable to only predetermined, discrete positions. Accordingly, the volumetric size of the interior of the processing chamber cannot be altered in small enough increments to accommodate textile fabrics in cloth rope form having the great variations in weight, texture, thickness, flexibility and load that are typically encountered in the wet processing of textile fabrics.

In addition, the design of the wet processing machine disclosed in the patent to Hacker et al. requires the operator to position himself uncomfortably within the interior portion of the U-shaped processing chamber to remove and replace the plurality of fasteners that reposition the inner wall relative to the outer wall. Further, each of the plurality of fasteners must first be aligned with the corresponding perforations pre-formed in the side walls to mount the inner wall to the side walls of the processing chamber. To reposition the inner wall (once the plurality of fasteners have been removed), it is typically necessary for a first operator to hold the relatively large inner wall in the desired position while a second operator replaces the plurality of fasteners in the corresponding perforations in the side walls.

Consequently, installing, servicing and repositioning the inner wall of the processing chamber is time consuming and requires considerable dexterity and skill. In wet processing operations that involve textile fabrics in cloth rope form having great variations in weight, texture, thickness, flexibility and load, the time required to reposition the inner wall to accommodate a different textile fabric may result in significant loss of production. Accordingly, the efficiency of the wet processing operation is greatly reduced, and the cost of processing the textile fabrics is greatly increased.

Further, each of the plurality of fasteners disclosed in the Hacker et al. patent consists of: (1) a hex head bolt having a threaded portion adjacent the end opposite the hex head; (2) an internally threaded nut for engaging the threaded portion of the hex head bolt; and (3) a cup-shaped bracket that engages the C-shaped lateral flanges of the inner wall when the nut is tightened on the bolt. Because each of the plurality of fasteners includes at least three small, separate pieces which must be removed and replaced, it is highly possible that at least one of the pieces of a fastener may loosen during operation of the wet processing machine and cause damage to the machine or to the interior of the processing chamber. If a cloth rope is subsequently circulated through the processing chamber, the expensive textile fabric could be irreparably damaged by the loose piece of the fastener inside the chamber. In addition, the loose piece of the fastener may damage the finish on an interior surface of the processing chamber. As a result, the textile fabric may be torn, ripped or damaged as it rotates through the processing chamber.

It is now apparent that the known textile wet processing machines do not adequately accommodate textile fabrics having great variations in weight, texture, thickness, flexibility and load. Accordingly, it is clear that a textile wet processing machine including a processing chamber having an adjustable inner wall to alter the volumetric size of the processing chamber is needed wherein: (1) the inner wall is continuously adjustable to any position relative to the outer wall between a predetermined innermost position and a predetermined outermost position; (2) the inner wall may be quickly and easily repositioned; and (3) the means for adjusting the inner wall does not include small, separate pieces that may loosen during operation of the wet processing machine and cause damage to the machine or to the interior of the processing chamber.

Accordingly, it is a principle object of the present invention to provide a textile wet processing machine including a processing chamber having an adjustable inner wall that is continuously adjustable to any position relative to the outer wall between a predetermined innermost position and a predetermined outermost position.

It is a further object of the invention to provide a textile wet processing machine including a processing chamber having an adjustable inner wall that may be quickly and easily repositioned so that adjustment of the inner wall to a new position is not time consuming and does not require considerable dexterity.

It is a further object of the invention to provide a textile wet processing machine including a processing chamber having an adjustable inner wall and adjustment means for adjusting the inner wall that does not include small, separate pieces that may loosen during operation of the wet processing machine and cause damage to the machine or to the interior of the processing chamber.

SUMMARY OF THE INVENTION

The invention is a textile wet processing machine including a processing chamber having an adjustable inner wall to accommodate textile fabrics in cloth rope form having great variations in weight, texture, thickness, flexibility and load. The inner wall is adjustable to any position relative to the outer wall between a predetermined innermost position and a predetermined outermost position. Thus, the processing chamber of the textile wet processing machine of the invention may be adjusted to differing volumetric sizes to enable the machine to realize its maximum capacity for treating a preselected textile fabric.

The present invention is a textile wet processing machine for treating textile fabric in continuous cloth rope form. The machine includes a hollow vessel, a processing chamber positioned within the vessel for receiving the textile fabric therein, means for introducing a treatment liquid, such as liquid dye solution, into the vessel, circulation means for circulating the textile fabric through the processing chamber, means for returning the treatment liquid from the processing chamber to the vessel, and pumping means for pumping the treatment liquid back into the vessel and the processing chamber. The circulation means for circulating the textile fabric is preferably located near the top of the vessel, and is provided for drawing the cloth rope from the outlet of the processing chamber and returning it to the inlet of the processing chamber so that the cloth rope is repeatedly circulated through the processing chamber.

The processing chamber includes a pair of opposed side walls, an outer wall extending transversely between the pair of opposed side walls, and an inner wall extending transversely between the pair of opposed side walls opposite the outer wall. Preferably, the means for returning the treatment liquid from the processing chamber is a plurality of perforations that are formed in the pair of opposed side walls, the outer wall or the inner wall. The processing chamber further includes adjustment means for positioning at least a portion of the inner wall at any position between a predetermined innermost position and a predetermined outermost position. Thus, the position of the portion of the inner wall relative to the outer wall of the processing chamber is continuously adjustable.

In a preferred embodiment, the adjustment means includes a worm gear assembly and a transverse drive shaft rotatably coupled to the worm gear assembly. The worm gear assembly includes a worm gear that is preferably positioned within a gear box housing and located medially between the opposed ends of an elongate rod. One end of the rod may be fixed to a hand wheel for manually adjusting the position of the inner wall of the processing chamber. Alternatively, one end of the rod may be releasably coupled to the cylindrical output shaft of an electric drive motor or pneumatic positioner for automatically adjusting the position of the inner wall of the processing chamber. In addition, the adjustment means may include an electronic processor for programming the electric drive motor or pneumatic positioner to automatically set the volumetric size of the processing chamber in accordance with a preselected textile fabric.

The transverse drive shaft has a first end and a second end, and includes a worm wheel adjacent the first end. The worm wheel has a plurality of external, circumferentially spaced gear teeth that engage the worm gear on the rod so that the transverse drive shaft rotates as the hand wheel or drive motor or pneumatic positioner is manipulated to rotate the rod. Preferably, the worm gear assembly further includes a bearing housing for counteracting side loads applied to the transverse drive shaft. The bearing housing includes a conventional lubricated slide or sleeve bearing and a plurality of packing rings for sealing the slide bearing and maintaining smooth operation of the transverse drive shaft under the influence of side loads.

The second end of the transverse drive shaft is attached directly to the inner wall of the processing chamber or to a drive shaft extension. Preferably, the adjustment means further includes a linkage assembly for transferring rotation of the transverse drive shaft (or drive shaft extension) to the inner wall. In a preferred embodiment, the linkage assembly includes a first rigid link fixed to and extending outwardly from the transverse drive shaft and a second rigid link rotatably secured to the free end of the first rigid link. The free end of the second rigid link is then secured to the inner wall of the processing chamber. Accordingly, rotation of the transverse drive shaft rotates the inner wall of the processing chamber about a pivot on a transverse axis extending between the pair of opposed side walls of the processing chamber.

Accordingly, the present invention provides a textile wet processing machine including a processing chamber having an inner wall that is continuously adjustable to any position relative to the outer wall between a predetermined innermost position and a predetermined outermost position. Thus, the machine is able to realize its maximum capacity for treating different textile fabrics having great variations in weight, texture, thickness, flexibility and load. The adjustment means of the processing chamber permits the inner wall to be quickly and easily repositioned so that adjustment of the inner wall to a new position is not time consuming and does not require considerable dexterity. Further, the adjustment means of the processing chamber does not include small, separate pieces that may loosen during operation of the machine and cause damage to the machine, to the interior of the processing chamber or to the textile fabric.

BRIEF DESCRIPTION OF THE DRAWINGS

The foregoing and other objects will become more readily apparent by referring to the following detailed description and the appended drawings in which.

DETAILED DESCRIPTION OF THE PREFERRED EMBODIMENTS

Preferably, the invention is embodied in a machine for wet processing textile fabrics in cloth rope form. Such a machine is known as a "textile wet processing machine," and the use of such a machine for dyeing textile fabrics in continuous cloth rope form is well understood by those skilled in the art. A more detailed description of a textile wet processing machine is provided in U.S. Pat. No. 5,014,526 issued May 14, 1991, to Hacker et al. The disclosure of the Hacker et al. patent is expressly incorporated herein to the extent that it describes the components of a textile wet processing machine other than the processing chamber.

Specifically, the present invention is directed to a processing chamber for a textile wet processing machine, and more specifically, to a means for adjusting the volumetric size of the processing chamber. In particular, the invention is a textile wet processing machine comprising a processing chamber having an adjustable inner wall to accommodate textile fabrics in cloth rope form having great variations in weight, texture, thickness, flexibility and load. The inner wall may be quickly and easily positioned at any position relative to the outer wall of the processing chamber between a predetermined innermost position and a predetermined outermost position. Because the volumetric size of the processing chamber is altered by adjustment of the position of the inner wall relative to the outer wall, the processing chamber enables the textile wet processing machine to realize its maximum capacity for treating a preselected textile fabric.

Briefly, a conventional textile wet processing machine comprises a closed, generally hollow pressure vessel utilized to treat textile fabrics in cloth rope form with a treatment liquid, such as a liquid dye solution. At least one processing chamber, as will be described in detail hereinafter, is positioned within the interior of the vessel. The textile wet processing machine further comprises means for introducing a treatment liquid, such as liquid dye solution, into the vessel, circulation means for circulating the textile fabric through the processing chamber, means for returning the treatment liquid from the processing chamber to the vessel, and pumping means for pumping the treatment liquid back to the vessel and the processing chamber. The circulation means for circulating the textile fabric is preferably located near the top of the vessel, and is provided to draw the cloth rope from the outlet of the processing chamber and return it to the inlet of the processing chamber so that the cloth rope is repeatedly circulated through the processing chamber.

Figure 1:
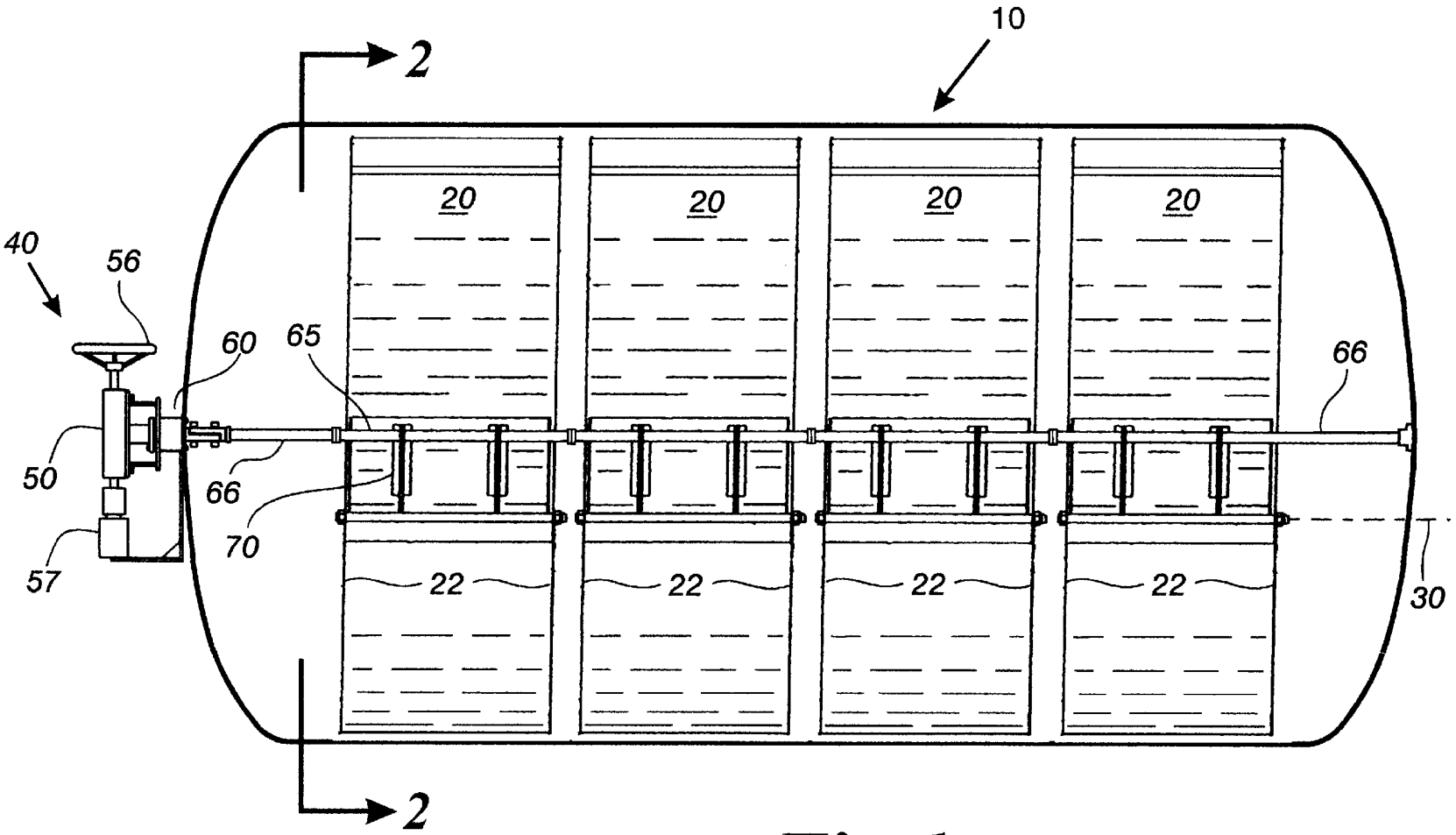
FIG. 1 is a top plan view of a preferred embodiment of a textile wet processing machine including a plurality of processing chambers, each having an adjustable inner wall according to the invention.
Figure 2:
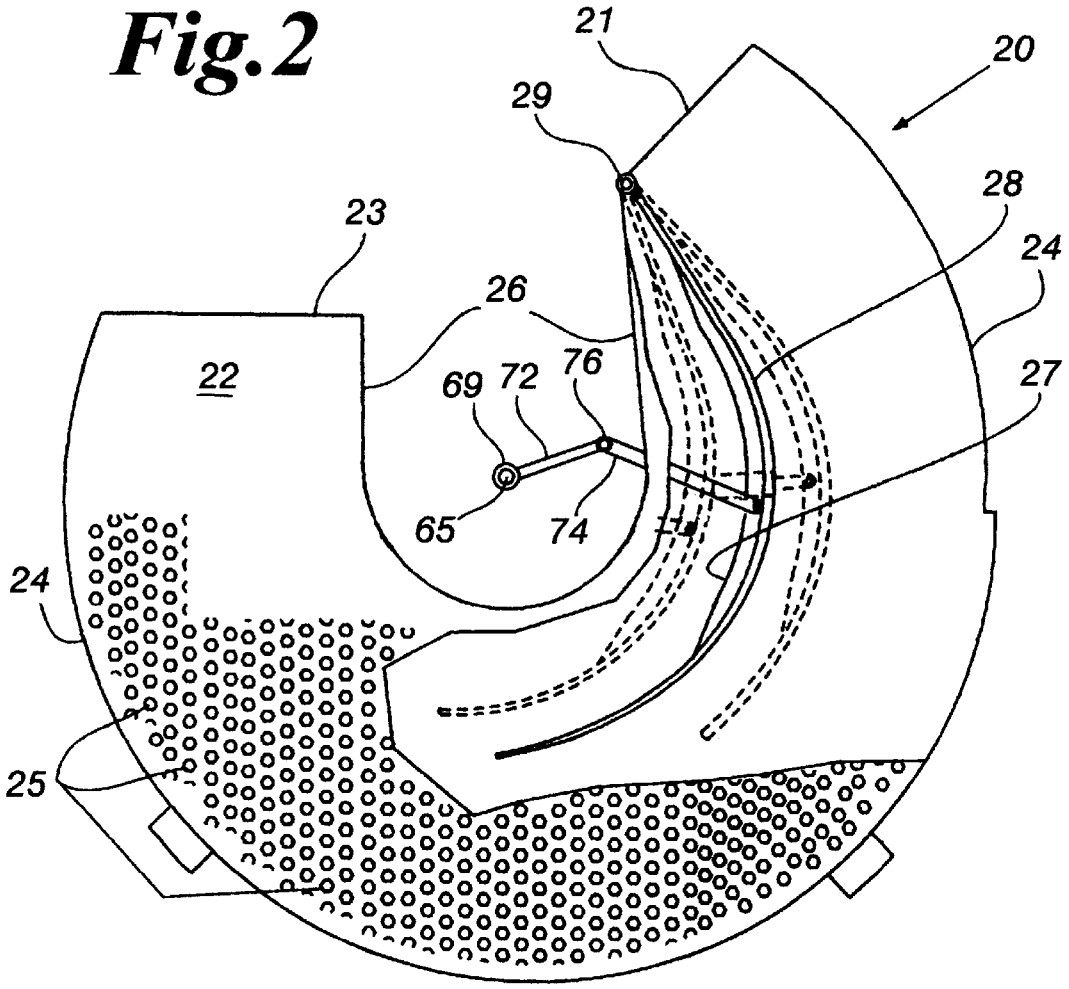
FIG. 2 is a sectional view of the textile wet processing machine of FIG. 1 taken along line 2—2 illustrating the innermost and outermost positions of the inner wall of one of the plurality of processing chambers.

Referring now to the accompanying drawings wherein like reference numerals indicate like parts, a textile wet processing machine, indicated generally at 10, is illustrated in FIG. 1. The textile wet processing machine 10 comprises at least one processing chamber, indicated generally at 20. However, as shown, the textile wet processing machine 10 may comprise a plurality of processing chambers 20 sequenced together to accommodate a corresponding plurality of textile fabrics in continuous cloth rope form. As best shown in FIG. 2, processing chamber 20 is generally hollow, U-shaped, and has an inlet end 21 which receives the cloth rope from the circulation means of the textile wet processing machine 10 and an outlet end 23 which returns the cloth rope to the circulation means of the textile wet processing machine. The processing chamber 20 comprises a pair of opposed side walls 22, an outer wall 24 that extends transversely between the pair of opposed side walls 22 and an inner wall 26 that extends transversely between the pair of opposed side walls opposite the outer wall. The opposed side walls 22, the outer wall 24 and the inner wall 26 may each include a plurality of perforations 25 in a predetermined pattern to route the treatment liquid to the returning means of the textile wet processing machine 10.

The inner wall 26 may be formed in one section, but preferably is formed in more than one section, as will be described. Regardless, at least a portion of the inner wall 26 is continuously adjustable to any position relative to the outer wall 24 between a predetermined innermost position and a predetermined outermost position. For example, the inner wall 26 may be formed of a first moveable section, preferably adjacent the inlet end 21 of the processing chamber 20, and a second fixed section, preferably adjacent the outlet end 23 of the processing chamber. In the preferred embodiment illustrated in FIGS. 1 and 2, the inner wall 26 comprises a baffle 28 that is rotatable about a transverse axis 30 (FIG. 1). As shown, a pivot 29 (FIG. 2) may be provided for rotatably securing the baffle 28 to at least one of the pair of opposed side walls 22. Preferably, the baffle 28 is stiffened against bending under the force of the textile fabric as it is circulated through the processing chamber 20 by one or more stiffeners 27 (FIG. 2).

The processing chamber 20 further comprises an adjustment means 40 for adjusting the position of the inner wall 26 relative to the outer wall 24. As indicated by the phantom lines in FIG. 2, the adjustment means 40 permits the position of the baffle 28 to be adjusted to any position relative to the outer wall 24 between a predetermined innermost position and a predetermined outermost position. Repositioning the baffle 28 of the inner wall 26 alters the volumetric size of the processing chamber 20. The differing volumetric sizes of the processing chamber 20 enable the textile wet processing machine 10 to accommodate textile fabrics in cloth rope form having great variations in weight, texture, thickness, flexibility and load.

Figure 4:
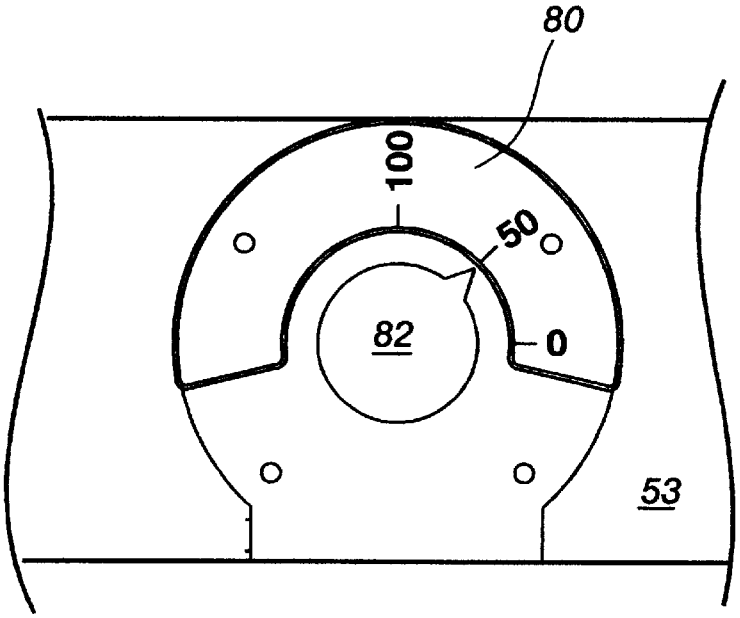
FIG. 4 is an end view of the adjustment means of FIG. 3 taken along the line 4—4.
Figure 3:
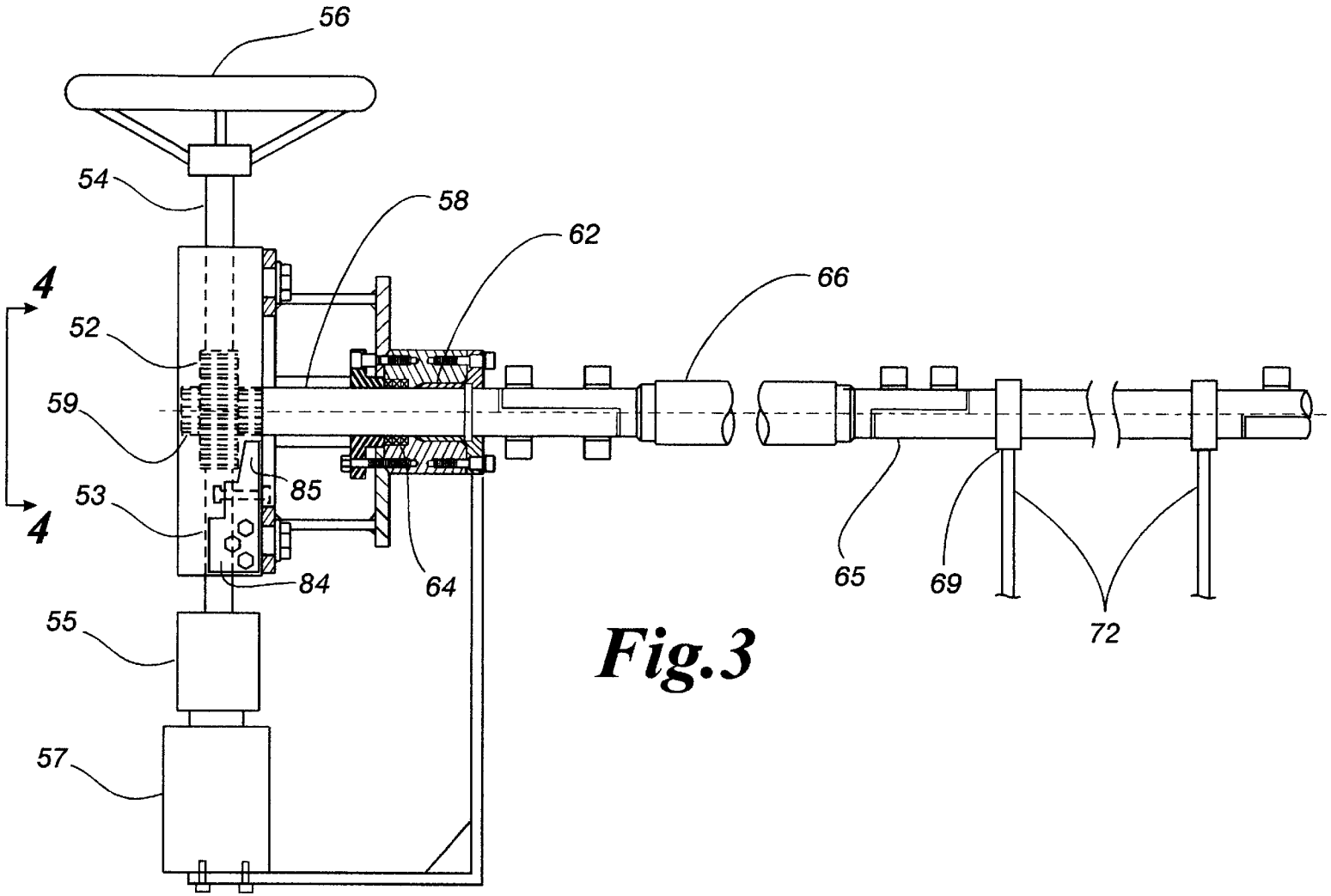
FIG. 3 is a detail top plan view of the adjustment means of the textile wet processing machine of FIG. 1.

In the preferred embodiment shown in FIGS. 3 and 4, the adjustment means 40 comprises a worm gear assembly 50, one or more drive shaft extensions 65 attached to the worm gear assembly which correspond to each of the processing chambers 20 utilized in the textile wet processing machine 10, and one or more linkage assemblies 70 (FIG. 2) attached to each of the drive shaft extensions. Preferably, the worm gear assembly 50 is fixed to the wall of the pressure vessel 12 of the textile wet processing machine 10. Alternatively, the worm gear assembly 50 may be supported on an independent stand adjacent the vessel so that the one or more drive shaft extensions 65 extend through the wall of the pressure vessel 12 into the at least one processing chamber 20 positioned within the textile wet processing machine 10.

The worm gear assembly 50 comprises a conventional worm gear 52 positioned within a gear box housing 53 and located medially between the ends of an elongate rod 54. One end of the rod 54 is fixed to a hand wheel 56 for manually adjusting the position of the inner wall 26 of the at least one processing chamber 20, as will be described. The opposite end of the rod 54 may be releasably coupled to the cylindrical output shaft 55 of an electric drive motor or pneumatic positioner 57 in a known manner, such as by an external chuck (not shown). The output shaft 55 rotates the rod 54 to automatically adjust the position of the inner wall 26 of the at least one processing chamber 20, as will be described. The drive motor or pneumatic positioner 57 may be used in conjunction with the hand wheel 56 to make gross and fine adjustments, respectively, to the position of the inner wall 26. In addition, the worm gear assembly may comprise a conventional electronic processor (not shown) for programming the drive motor or pneumatic positioner 57 to automatically set the volumetric size of the processing chamber 20 in accordance with a preselected textile fabric.

The worm gear assembly 50 further comprises a transverse drive shaft 58 rotatably coupled to the worm gear 52 for rotating each of the transverse drive shaft extensions 65 corresponding to each of the processing chambers 20 utilized in the textile wet processing machine 10. At one end, the transverse drive shaft 58 comprises a worm wheel 59 positioned adjacent the worm gear 52. The worm wheel has a plurality of external, circumferentially spaced gear teeth that engage the worm gear 52 on rod 54 in a known manner so that the transverse drive shaft 58 rotates as the hand wheel 56 or drive motor or pneumatic positioner 57 rotates rod 54. The worm gear assembly 50 further comprises a bearing housing 60 for counteracting side loads applied to the transverse drive shaft 58 of the textile wet processing machine 10. The bearing housing 60 houses a conventional lubricated slide, or sleeve, bearing 62 and a plurality of packing rings 64 for sealing the slide bearing and maintaining smooth operation of the transverse drive shaft 58 under the influence of side loads.

As best shown in FIG. 3, the transverse drive shaft 58 is secured to one or more drive shaft extensions 65. The first drive shaft extension 65 may operate as a "dummy" drive shaft extension 66 to bridge the gap between the wall of the pressure vessel 12 of the textile wet processing machine 10 and the first processing chamber 20. Similarly, a dummy drive shaft extension 66 may be utilized to bridge the gap between the final processing chamber 20 and the opposite wall of the pressure vessel 12. The dummy drive shaft extension 66 comprises an elongate rod having a means for attachment to the transverse drive shaft 58 at one end and to a second drive shaft extension 65 at the other end. The second (and any subsequent) drive shaft extension 65 differs from the dummy drive shaft extension 66 in that it is provided with one or more fittings 69 for welding the drive shaft extension 65 to each of the one or more linkage assemblies 70. As required, an additional drive shaft extension 65 may be attached using the attachment means at the free end of the second (and any subsequent) drive shaft extension to rotate the baffle 28 of the inner wall 26 of each processing chamber 20 utilized in the textile wet processing machine 10.

Each of the one or more linkage assemblies 70 comprises a first rigid link 72 rotatably secured to a second rigid link 74. The first rigid link 72 of each of the linkage assemblies 70 is fixed to the fitting 69 welded on the drive shaft extension 65. Thus, the first rigid link 72 is fixed to and extends outwardly from the drive shaft extension 65. The second rigid link 74 (FIG. 2) is rotatably secured to the free end of the first rigid link 72 by a pivot 76 (FIG. 2). The free end of the second rigid link 74 is then secured to the baffle 28 of the inner wall 26 (FIG. 2) so that the inner wall of each processing chamber 20 is movable, and specifically, so that the baffle of the inner wall is rotatable about the transverse axis 30 (FIG. 2).

As illustrated in FIG. 4, the position of the inner wall 26 of each processing chamber 20 may be continuously adjusted relative to the outer wall 24 between a predetermined innermost position and a predetermined outermost position. Preferably, a scale 80 and an indicator 82 are provided on the external face of the gear box housing 53 adjacent the worm wheel 59 of the transverse drive shaft 58. The scale 80 is fixed to the external face of the gear box housing 53 while the indicator 82 is fixed to the free end of the transverse drive shaft 58. Thus, as the transverse drive shaft 58 rotates to adjust the position of the inner wall 26 of the processing chamber 20 relative to the outer wall 24, the indicator 82 reflects the relative position of the inner wall. As shown, the predetermined innermost position of the inner wall 26 (i.e., wherein the volumetric size of the processing chamber 20 is as large as possible) is indicated by the mark "100" percent on the scale 80, and the outermost position of the inner wall 26 (i.e., wherein the volumetric size of the processing chamber 20 is as small as possible) is indicated by the mark "0" percent on the scale 80.

Preferably, the adjustment means 40 further comprises a releasable locking mechanism 84 to prevent further rotation of the worm wheel 59 in response to the worm gear 52 (and thus further rotation of the transverse drive shaft 58 and drive shaft extension 65). Accordingly, once the position of the inner wall 26 of the processing chamber 20 has been established for a preselected textile fabric, inadvertent manipulation of the hand wheel 56 or operation of the drive motor or pneumatic positioner 57 will not readjust the position of the inner wall 26 relative to the outer wall 24 of the processing chamber 20. Similarly, the locking mechanism 84 prevents movement of the inner wall 26 in the direction away from the outer wall 24 under the force of the mass of the cloth plug as it circulates through the processing chamber 20 of the textile wet processing machine 10. Thus, the adjustable portion of the inner wall 26 (i.e., the baffle 28) will not move relative to the outer wall 24 during operation and thereby alter the volumetric size of the processing chamber 20. The locking mechanism 84 may, for example, comprise an external tooth 85 fixed to the gear box housing 53 for releasably engaging one or more of the external teeth of the worm wheel 59.

As is now apparent, the invention provides a textile wet processing machine comprising a processing chamber having an adjustable inner wall to accommodate textile fabrics in cloth rope form having great variations in weight, texture, thickness, flexibility and load. Accordingly, the volumetric size of the processing chamber may be altered to enable the wet processing machine to realize its maximum capacity for treating a preselected textile fabric. It should be emphasized that the present invention provides a processing chamber having an adjustable inner wall that is quickly and easily repositioned so that the efficiency of the wet processing operation is not greatly reduced, and the cost of processing the textile fabrics is not greatly increased. In addition, the adjustment means disclosed herein does not include small, separate pieces that may loosen during operation of the wet processing machine and cause damage to the machine, to the interior of the processing chamber or to the textile fabric.

Obviously, many alternative embodiments and modifications of the invention are within the level of ordinary skill of those accomplished in the art of wet processing textile fabrics. Thus, it is to be understood that the invention is not intended to be limited to the preceding description of the preferred embodiment, or by the specific embodiment illustrated in the accompanying drawings. Rather, it is intended that the invention encompass all embodiments within the spirit and scope of the inventive concept disclosed herein.

That which is claimed is:

1. A textile wet processing machine for wet processing textile fabric in continuous cloth rope form, said machine comprising a processing chamber comprising a pair of opposed side walls;

an outer wall extending transversely between said pair of opposed side walls; and an inner wall extending transversely between said pair of opposed side walls opposite said outer wall; and adjustment means for positioning at least a portion of said inner wall at any position relative to said outer wall between a predetermined innermost position and a predetermined outermost position, said adjustment means comprising a worm gear; and a transverse drive shaft having a first end and a second end, said transverse drive shaft rotatably coupled to said worm gear adjacent the first end and attached to said portion of said inner wall medially between the first end and the second end.

2. A textile wet processing machine according to claim 1 wherein said portion of said inner wall is rotatable about a transverse axis extending between said pair of opposed side walls.

3. A textile wet processing machine according to claim 2 wherein said processing chamber further comprises a pivot for rotatably securing said portion of said inner wall about said transverse axis.

4. A textile wet processing machine according to claim 1 wherein said adjustment means further comprises a linkage assembly comprising a first rigid link fixed to and extending outwardly from said transverse drive shaft; and a second rigid link rotatably secured to the free end of said first rigid link, the free end of said second rigid link secured to said portion of said inner wall of said processing chamber.

5. A textile wet processing machine according to claim 4 wherein said adjustment means further comprises a first pivot for rotatably securing said second rigid link to said first rigid link; and a second pivot for rotatably securing said portion of said inner wall about a transverse axis.

6. A textile wet processing machine according to claim 1 wherein said worm gear is positioned within a gear box housing and located medially between the opposed ends of an elongate rod and wherein one end of said rod is fixed to a hand wheel for manually adjusting the position of said inner wall of said processing chamber.

7. A textile wet processing machine according to claim 1 wherein said worm gear is positioned within a gear box housing and located medially between the opposed ends of an elongate rod and wherein one end of said rod is releasably coupled to the cylindrical output shaft of an electric drive motor or pneumatic positioner for automatically adjusting the position of said inner wall of said processing chamber.

8. A textile wet processing machine according to claim 1 wherein said adjustment means further comprises locking means for releasably locking said portion of said inner wall at said any position relative to said outer wall between said innermost position and said outermost position.

9. A textile wet processing machine according to claim 1 wherein at least one of said pair of opposed side walls of said processing chamber has a plurality of perforations therethrough.

10. A textile wet processing machine according to claim 1 wherein said outer wall of said processing chamber has a plurality of perforations therethrough.

11. A textile wet processing machine according to claim 1 wherein said inner wall of said processing chamber has a plurality of perforations therethrough.

12. A textile wet processing machine for wet processing textile fabric in continuous cloth rope form, said machine comprising a hollow vessel;

at least one processing chamber positioned within said vessel for receiving the textile fabric therein, said processing chamber comprising a pair of opposed side walls;

an outer wall extending transversely between said pair of opposed side walls;

an inner wall extending transversely between said pair of opposed side walls opposite said outer wall, at least a portion of said inner wall rotatable about a transverse axis extending between said pair of opposed side walls; and a first pivot for rotatably securing said portion of said inner wall about said transverse axis; and adjustment means for positioning said portion of said inner wall at any position relative to said outer wall between a predetermined innermost position and a predetermined outermost position, said adjustment means comprising a worm gear; and a transverse drive shaft having a first end and a second end, said transverse drive shaft rotatably coupled to said worm gear adjacent the first end and attached to said portion of said inner wall medially between the first end and the second end.

13. A textile wet processing machine according to claim 12 wherein said adjustment means of said processing chamber further comprises a linkage assembly comprising a first rigid link fixed to and extending outwardly from said transverse drive shaft; and a second rigid link rotatably secured to the free end of said first rigid link, the free end of said second rigid link secured to said portion of said inner wall of said processing chamber.

14. A textile wet processing machine according to claim 13 wherein said adjustment means of said processing chamber further comprises a second pivot for rotatably securing said second rigid link to said first rigid link.

15. A textile wet processing machine according to claim 12 wherein said worm gear is positioned within a gear box housing and located medially between the opposed ends of an elongate rod and wherein one end of said rod is fixed to a hand wheel for manually adjusting the position of said inner wall of said processing chamber.

16. A textile wet processing machine according to claim 12 wherein said worm gear is positioned within a gear box housing and located medially between the opposed ends of an elongate rod and wherein one end of said rod is releasably coupled to the cylindrical output shaft of an electric drive motor or pneumatic positioner for automatically adjusting the position of said inner wall of said processing chamber.

17. A processing chamber for wet processing textile fabric in continuous cloth rope form, said chamber comprising a pair of opposed side walls;

an outer wall extending transversely between said pair of opposed side walls;

an inner wall extending transversely between said pair of opposed side walls opposite said outer wall, at least a portion of said inner wall rotatable about a transverse axis extending between said pair of opposed side walls;

a first pivot for rotatably securing said portion of said inner wall about said transverse axis;

adjustment means for positioning said portion of said inner wall at any position relative to said outer wall between a predetermined innermost position and a predetermined outermost position, said adjustment means comprising a worm gear; and a transverse drive shaft having a first end and a second end, said transverse shaft rotatably coupled to said worm gear adjacent the first end and attached to said portion of said inner wall medially between the first end and the second end.

* * * * *